US007699272B2

(12) United States Patent
Arnold

(10) Patent No.: US 7,699,272 B2
(45) Date of Patent: Apr. 20, 2010

(54) RAILROAD SWITCHING INDICATOR MECHANISM

(76) Inventor: Jim Arnold, P.O. Box 600, Grass Valley, CA (US) 95945

( * ) Notice: Subject to any disclaimer, the term of this patent is extended or adjusted under 35 U.S.C. 154(b) by 165 days.

(21) Appl. No.: 11/898,666

(22) Filed: Sep. 14, 2007

(65) Prior Publication Data

US 2009/0072097 A1 Mar. 19, 2009

(51) Int. Cl.
*B61L 5/00* (2006.01)

(52) U.S. Cl. ..... 246/220; 246/253

(58) Field of Classification Search ..... 246/253, 246/401, 220, 476, 176, 217
See application file for complete search history.

(56) References Cited

U.S. PATENT DOCUMENTS 929,363 A * 7/1909 Zele ..... 246/220
2,082,142 A * 6/1937 Bone ..... 246/253
2,348,707 A * 5/1944 Bone ..... 246/253
2,434,722 A * 1/1948 Rutledge et al. ..... 246/401
2,439,020 A * 4/1948 Orville ..... 246/401
2,490,742 A * 12/1949 Smith ..... 246/393
2,698,378 A * 12/1954 Speer ..... 246/253
4,093,163 A * 6/1978 Larsson ..... 246/476
4,896,850 A * 1/1990 Carmes ..... 246/476
4,921,189 A * 5/1990 Callegari ..... 246/448
5,531,408 A * 7/1996 Wechselberger ..... 246/257
5,586,737 A * 12/1996 van Alstine et al. ..... 246/448
5,620,156 A * 4/1997 Berggren et al. ..... 246/221
5,669,587 A * 9/1997 Van Alstine et al. ..... 246/220
5,806,809 A * 9/1998 Danner ..... 246/220
6,062,514 A * 5/2000 McQuistian ..... 246/218
6,149,106 A * 11/2000 McQuistian ..... 246/220
6,186,448 B1 * 2/2001 Wydotis et al. ..... 246/220
6,382,567 B2 * 5/2002 Franke ..... 246/476
6,427,949 B1 * 8/2002 Hager et al. ..... 246/220
6,484,974 B1 * 11/2002 Franke et al. ..... 246/476
6,568,641 B2 * 5/2003 Hoyer et al. ..... 246/257
6,578,799 B1 * 6/2003 Brushwood ..... 246/220
6,585,194 B1 * 7/2003 Brushwood ..... 246/220
6,588,710 B1 * 7/2003 Taylor ..... 246/220
6,663,052 B1 * 12/2003 Brushwood ..... 246/220
6,688,559 B1 * 2/2004 Brushwood ..... 246/220
6,691,958 B2 * 2/2004 Biagiotti ..... 246/415 R
7,134,632 B2 * 11/2006 Brown et al. ..... 246/220
7,168,662 B1 * 1/2007 McQuistian et al. ..... 246/449
7,191,986 B2 * 3/2007 Achleitner et al. ..... 246/253
7,282,816 B2 * 10/2007 Ridgeway ..... 307/115
2001/0054670 A1 * 12/2001 Franke ..... 246/220
2002/0096604 A1 * 7/2002 Hager et al. ..... 246/220
2003/0106967 A1 * 6/2003 Brushwood ..... 246/220
2008/0179467 A1 * 7/2008 Wagner et al. ..... 246/220
2009/0045297 A1 * 2/2009 Achleitner et al. ..... 246/220
2009/0072097 A1 * 3/2009 Arnold ..... 246/220

FOREIGN PATENT DOCUMENTS

WO PCT/SE94/00502 12/1994
WO PCT/EP98/06597 4/1999

* cited by examiner

*Primary Examiner*—Mark T Le
*Assistant Examiner*—Jason C Smith
(74) *Attorney, Agent, or Firm*—Theordore J. Bielen, Jr.

(57) ABSTRACT

A railroad switching indicator apparatus for use with a point detector bar, and a point locking rod which cooperatively locks with a locking bar. First and second point detector bar receptors generate first and second signals indicating the first and second terminal movements of the point detector bar. At the same time, a point lock rod receptor generates another signal indicating the locking of the locking bar with the point locking rod.

12 Claims, 5 Drawing Sheets

RAILROAD SWITCHING INDICATOR MECHANISM

BACKGROUND OF THE INVENTION

The present invention relates to a novel and useful railroad switching indicator mechanism for use with an internal point detector bar, and an internal point lock rod which cooperates with a locking bar.

It is often necessary to switch a railroad track to allow a train to travel therefrom to either of two tracks which split away from the first track. To achieve this result, switch mechanisms have been deployed for many years utilizing moveable rails. The moveable rails are normally referred to as points or blades, since such rails narrow to an edge at one end thereof. Known mechanisms, in the form of switching apparatuses, include an internal point lock rod which cooperates or interacts with a locking bar to hold the points against the fixed rails. In addition, an internal point detector bar is employed in order to assure that the movement of the points has taken place completely such that the points are positioned closely to the fixed rail. If such positioning does not take place within strict tolerances (¼" or greater), this would indicate a switching obstruction which could result in a train being derailed at the switching apparatus.

Detector systems have been devised to indicate the movement of the points from one position to the other. However, it has been found that prior detector mechanism are subject to mechanical wear and, at times, break or provide a false signal as to the switching position of the points. Electronic sensors have also been devised but have not proven to be durable enough to properly operate over long periods of time.

In this regard, many systems have been devised for operating and detecting the position of the points in a switching apparatus of a railroad track. For a example, U.S. Pat. Nos. 929,363, 2,082,142, 2,348,707, and 2,698,378 utilize a point detecting connecting rod which moves with the internal points and operates switches through sensors associated with the internal point detector bar.

U.S. Pat. Nos. 4,896,850, and 6,688,559 show point position indicators which employ rotating bodies and gears that are associated with the movement of an internal point detector bar.

U.S. Pat. Nos. 4,093,163, 6,691,958, and PCT Publications WO 9427853 and WO 9920512 depict point detector mechanism having switches which engage at the two extremes of the points movement to show that the switching of the rails have been accomplished.

U.S. Pat. Nos. 5,806,809, 6,062,514, and 6,382,567 describe switching point positions sensors in which proximity detectors are used with the internal point detector bar to indicate the integrity of a switching operation.

U.S. Pat. Nos. 6,484,974, and 6,585,194 show sensors for determining the position of switching rails in which electronic sensors or employed and which may be adjustable for positioning of the same.

A railroad switching indicator which employs sensors to indicate the switching and locking of points in a switching apparatus between two positions would be a notable advance in the field of transportation.

BRIEF SUMMARY OF THE INVENTION

In accordance with the present invention a novel and useful railroad switching indicator apparatus is hereinafter described.

The apparatus of the present invention is useable with an internal point detector bar or rod normally connected at right angles to the points found in a railroad switching apparatus. In addition, an internal point lock rod and cooperating point locking bar are used with the indicator of the present invention. A first point detector receptor generates a first signal indicating the first position of the internal point detector bar while a second point detector receptor generates a second signal indicating the second position of the internal point detector bar. Normally, the first and second positions of the point detector bar corresponds to the full movement of the points of a railroad switching apparatus allowing a train to move from one track to another.

A first actuator is connected to the point detector bar and is moveable therewith. The first actuator selectively interacts with the first and second receptors to initiate the generation of the first and second signals.

In addition, a point lock bar receptor is employed in the present invention to generate a third signal indicating the cooperating locking of the internal point lock rod with the locking bar. The second actuator is connected to and moves with the locking bar to initiate the third signal by interacting with the third receptor. In addition, a fourth receptor may be included in the mechanism of the present invention to indicate the unlocked condition of the internal point lock rod with the cooperating point locking bar.

The first, second, third, and fourth receptors may constitute electrical conductors that are, relatively, fixed to the moving point internal detector rod and cooperating point locking bar. Likewise, the first and second actuators may take the form of electrical conductors that are appended and move with the internal point detector bar and the cooperating point locking bar, respectively. In any case, contact or magnetic presence (reed switch) must be made between any actuators and receptors as heretofore described. When such contact occurs, an electrical signal would be generated which may then be acquired by a user or operator via an alarm, such as a light, a sound, a meter deflection, and the like. Also, the signals generated by the mechanism of the present invention may be employed to assure that a train may pass through a switching apparatus without fear of derailment. Consequently, the absence of any of the signals generated by the receptors of the mechanism of the present invention could be translated into a command to stop the movement of the train approaching a switching apparatus, since such absence of signals indicates that the points have not been fully switched and locked into place.

It may be apparent that a novel and useful railroad switching indicator mechanism has been hereinabove described.

It is therefore an object of the present invention to provide a railroad switching indicator mechanism which is extremely reliable and assures that points in a switching apparatus have completely traveled from one position to another position to effect of switching of rails for a railroad train.

Another object of the present invention is to provide a railroad switching indicator mechanism which is durable and reliable.

A further object of the present invention is to provide a railroad switching indicator mechanism which includes a backup mechanism, thus, insuring that railroad points have been switched and are also locked into position.

Its another object of the present invention is to provide a railroad switching indicator mechanism which may be retrofitted to railroad switching apparatus.

A further object of the present invention is to provide a railroad switching indicator mechanism which detects a damaged or worn rail point.

The invention possesses other objects and advantages which may be apparent to a person of ordinary skill in the art.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
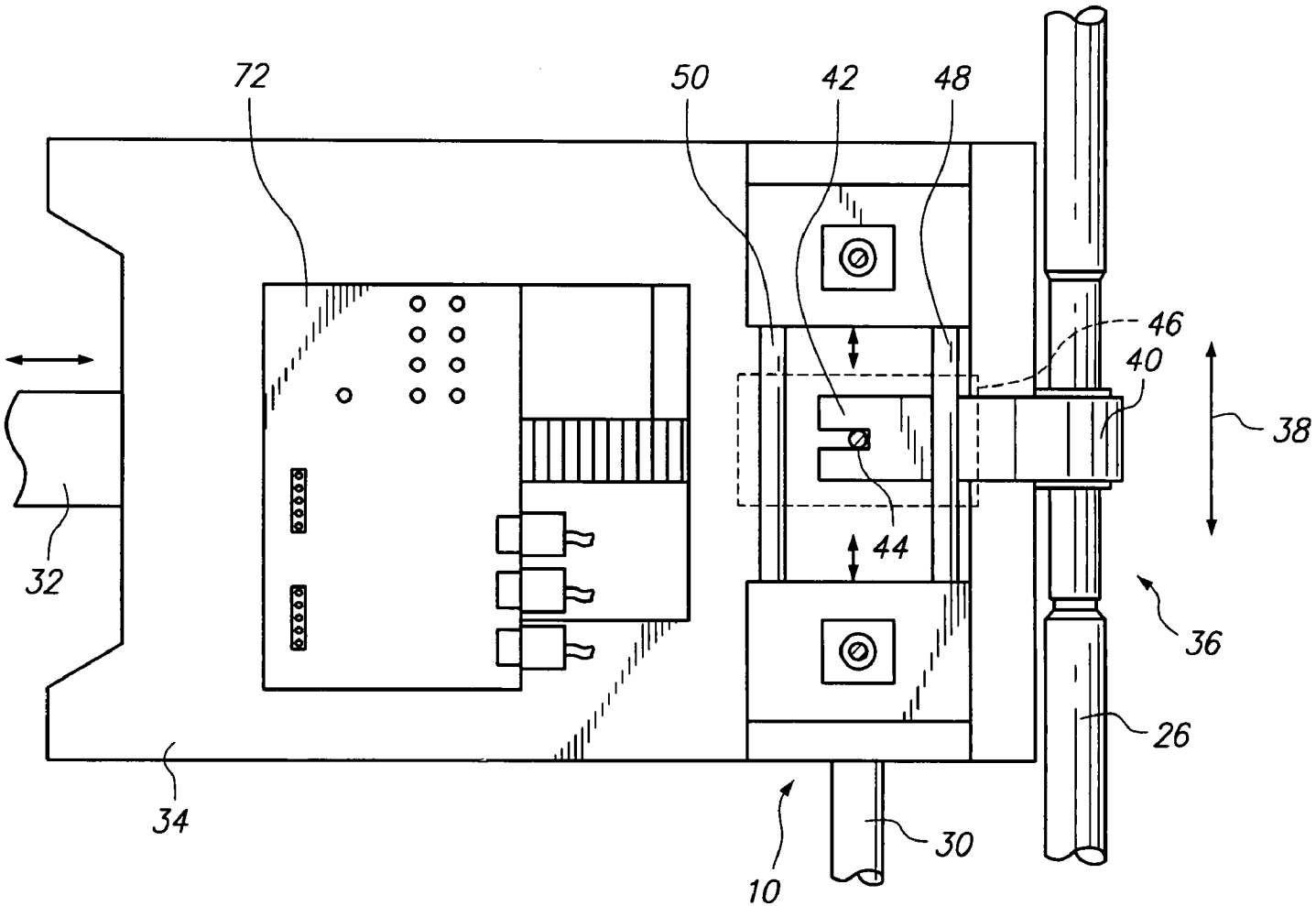
FIG. 1 is a top plan view of the mechanism of the present invention shown in conjunction with an internal point detector bar, an internal point lock rod, and a cooperating locking bar.
Figure 6:
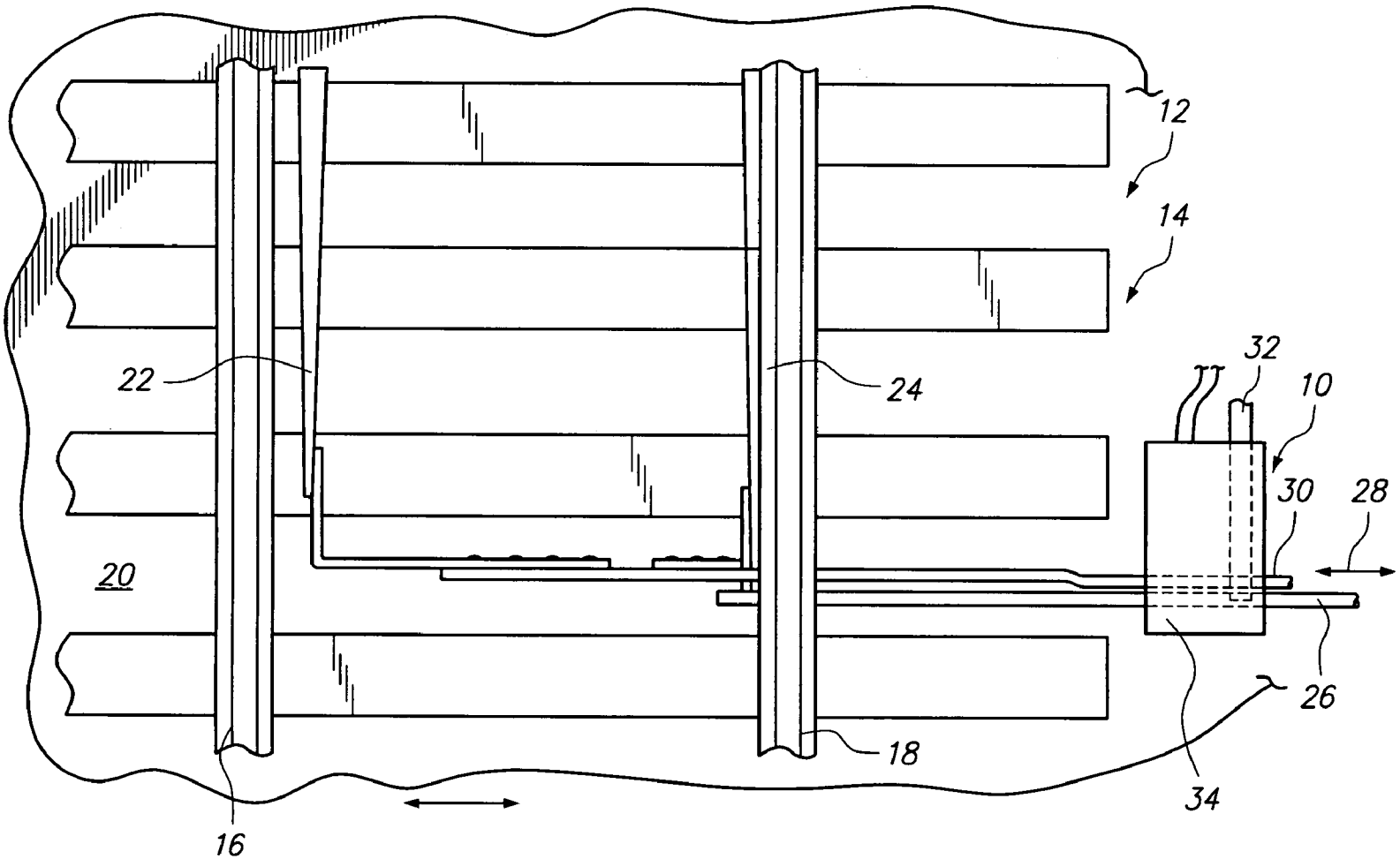
FIG. 6 is a partial top plan view of a railroad track showing a point switching mechanism and the device of the present invention in schematic rendition.

Mechanism 10, FIG. 1, is employed with a railroad switching apparatus 12, well known in the art. With reference to FIG. 6, it may be observed that a plurality of cross-ties 14 support fixed rails 16 and 18 on a bed or surface 20. Points or blades 22 and 24 are moved between fixed rails 16 and 18 by an electrical motor or manually through a mechanical linkage, not shown. An internal point detector bar/or indicator rod 26 moves with points 22 and 24 according to directional arrow 28. Likewise, internal point locking rod 30 also moves with points 22 and 24 and interacts with a locking bar 32 through a series of notches found on internal point locking rod 30, Such interaction is known and prior described in U.S. Pat. No. 2,348,707, as well as in other prior art documents. In any case, internal point indicator bar 26 and internal point locking rod 30 are physically linked to points 22 and/or 24 and occupy a particular position in space, such as when point 24 is against rail 18 or point 22 is against rail 16, the former position being, depicted in FIG. 6.

Figure 4:
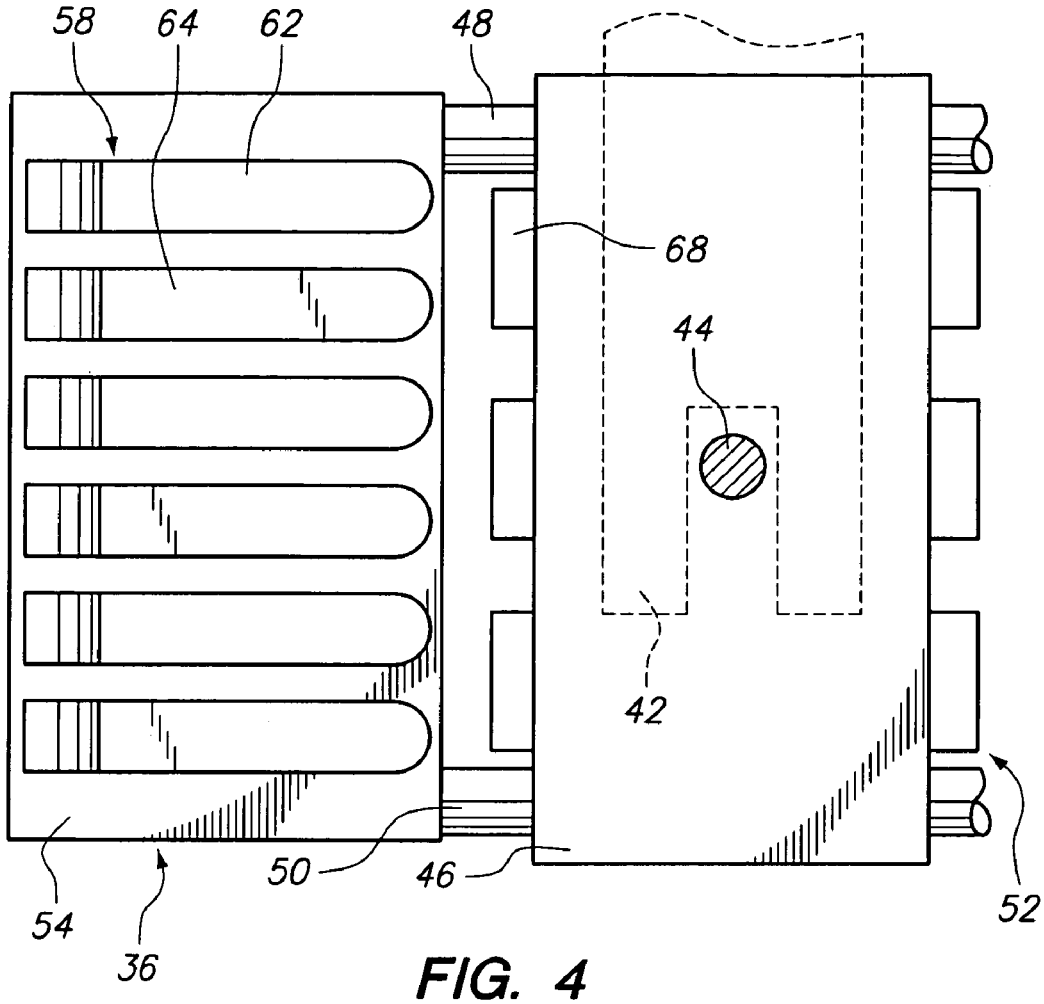
FIG. 4 is a sectional view taken along line 4-4 of FIG. 3.

Returning to FIG. 1, it may be seen that mechanism 10 includes a console 34 which positions relative to point detector bar 26, internal point locking rod 30, and cooperating locking bar 32. A first actuator 36 is connected to internal point detector bar 26 for movement therewith according to directional arrow 38. First actuator 36 includes a surrounding or encompassing appendage or flag 40 having a forked terminus 42, Forked terminus 42 engages a shaft 44 which fixes to a moveable base 46, shown in phantom on FIG. 1. Base 46 moves along guides 48 and 50 according to the movement of flag 40 and internal point indicator bar 26. With reference to FIG. 4, it may be seen that base 46 possesses a plurality of conductors 52 in the form of metallic strips. Base 46 travels to the vicinity of separated housings 54 or 56. It should be noted that housing 54 or 56 may be adjustable along rods 48 and 50 commensurate with the throw or travel of internal point detector bar 26. In any case, examplar housing 54 includes a plurality of contacts or receptors 58 in the form of metallic strips which are intended to interact with the plurality of conductors 52 of base 46. Such interaction of plurality of conductors 52 with plurality of contacts 58 generate a signal passing through an electrical conductor 60. That is to say, a source of electrical energy is passed to electrical contacts 62 and 64 and a circuit is completed by the touching of either of the same by contact 68. An identical situation exists with the remaining plurality of electrical contact 58 and plurality of electrical conductors 52. Similarly, an electrical signal is also passed through electrical conduit 70 by the interaction of plurality of conductors 52 with contacts found in housing 56. Reed switches and magnets may be substituted for plurality of receptors 58 and conductors, respectively. A similar interaction occurs with respect to the receptors of housing 56.

Signals passing through electrical conduits 60 and 70 represent the first and second positions of internal point indicator bar 26 and, thus, the two positions of internal points 22 and 24 of switch apparatus 12. That is to say, housing 56 is similarly constructed to housing 54 with respect to its ability to interact with the plurality of electrical conductors 52 of base 46, i.e., possessing a plurality of electrical contacts similar to electrical contacts 58. The signals passing through electrical conduits 60 and 70 travel to a receiver 72 which may generate an alarm, a visual rendition, a sound, or the like which would correspond with the movements of points 22 and 24 into their extreme positions against tracks 16 and 18, or the absence of such movement and positioning.

Figure 2:
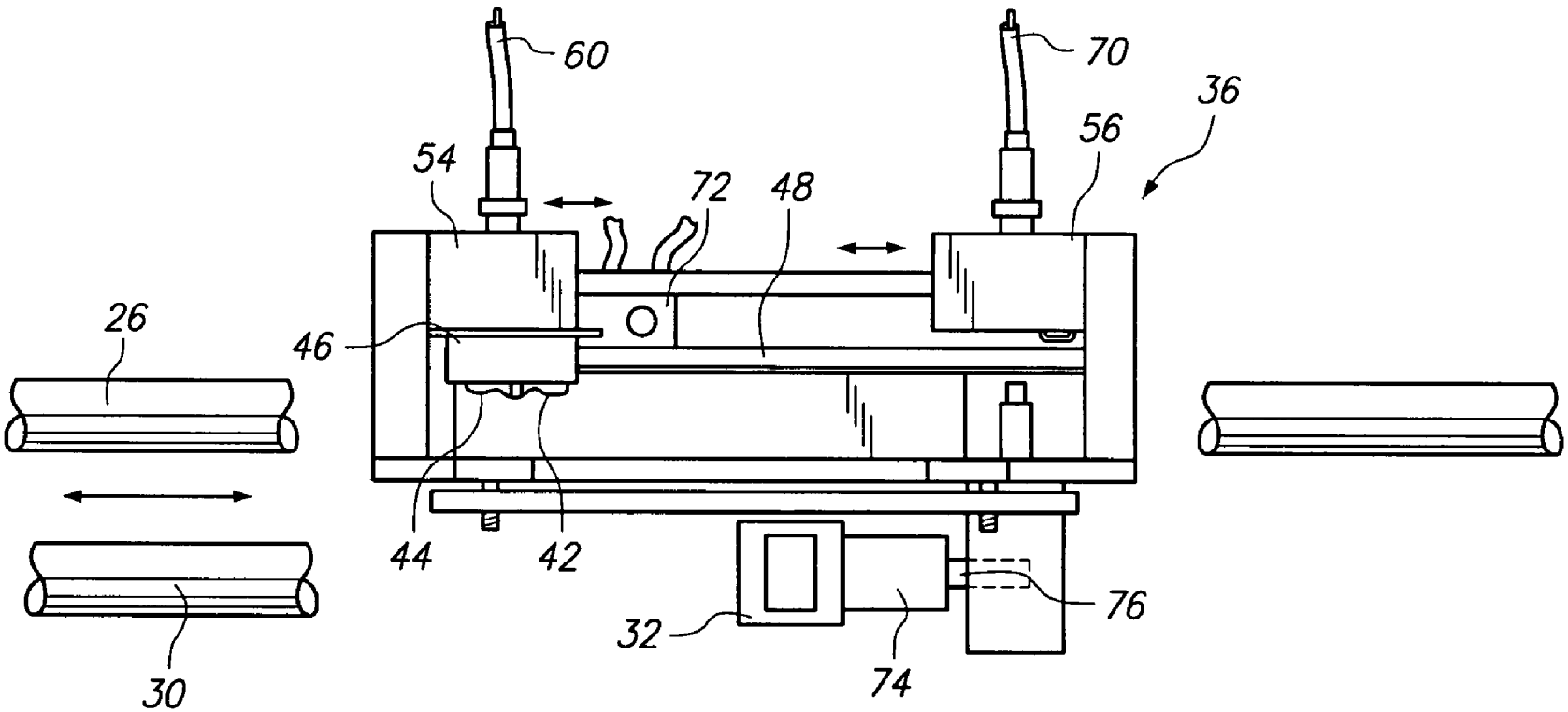
FIG. 2 is a right side elevational view of the mechanism depicted in FIG. 1, showing the railroad switching apparatus components in part.
Figure 3:
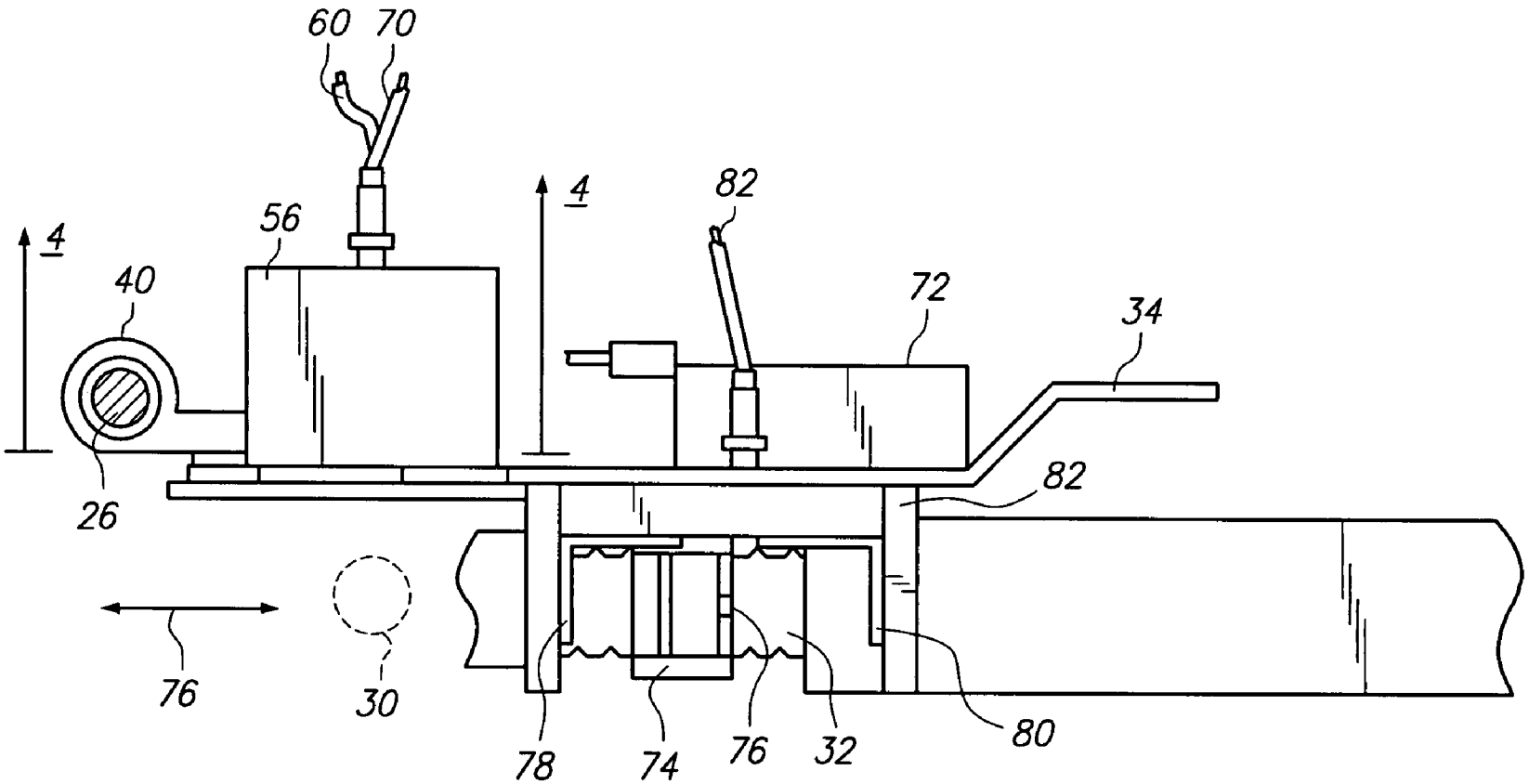
FIG. 3 is a side elevational view of the mechanism of FIG. 1 rotated 90° from that shown in FIG. 2 and taken from the top of the illustration of FIG. 1.

Turning to FIG. 3, it may be apparent that the present invention of mechanism 10 also provides for a second actuator 74 which is fixed to internal locking bar 32 that cooperates with point lock rod 30, traveling according to directional arrow 75. Interlocking engagement with internal point lock rod 30 occurs at either extreme of the movement points 22 and 24, heretofore described. Actuator 74 is provided with a conductor 76 which interacts with either contact/receptor 78 or contact/receptor 80. Contact 80 interacting with conductor 76 would indicate that the points 22 and 24 are in a unlocked position while contact 78 interacting with conductor 76 indicates that points 22 and 24 are locked in either the position shown in FIG. 6, or in a position where point 22 lies against rail 16. Again, these two positions also represent the two extreme positions of point indicator bar 26. Moreover, an electrical signal is generated through the appropriate circuitry by the touching of conductor 76 with either contact 78 or 80 and passed through electrical conduit 82 to receiver 72, FIGS. 2 and 3. It should be realized that contacts 78 and 80 are held to a U-shaped chassis 82 which is connected to console 34.

Figure 5:
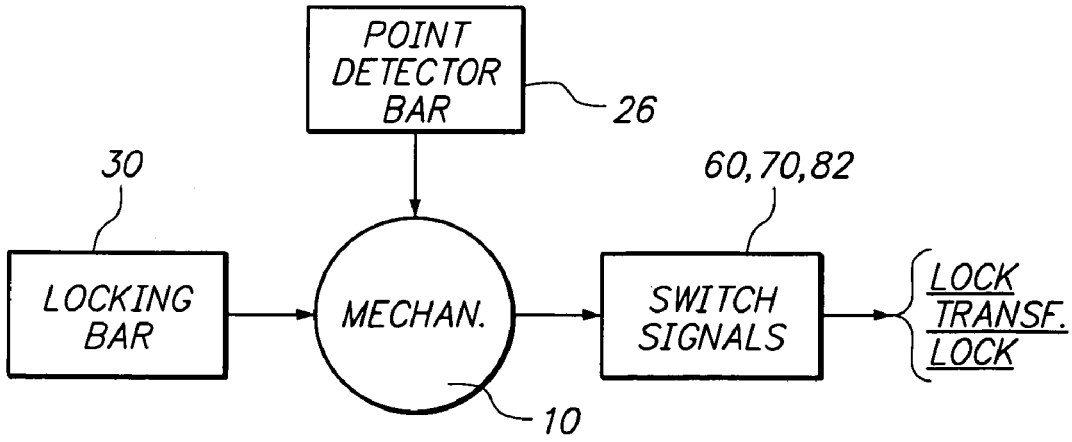
FIG. 5 is a block diagram indicating the overall operation of the mechanism of the present invention generating signals indicating the position of railway points.

In operation, points 22 and 24 are moved either to the left or to the right against fixed rail 16 or 18, FIG. 6, by the conventional switching operation of switch apparatus 12. Such movement also creates the travel of internal point indicator bar 26. Actuator 36, through flag appendage 40, moves base 46 back and forth to effect the circuit completion between electrical conductors 52 with either the electrical contacts 58 of housing 54 or the similar electrical contacts of housing 56. In any case, either event will create electrical signals which pass through electrical conduits 60 and 70 that are sent to receiver 72 for processing and indicating the travel of internal point indicator bar 26. The distance of travel of point indicator bar 26 also determines the distance between housings 54 and 56, which are adjustable in relation to one another along rods 48 and 50. At the same time electrical signals are generated through conduits 60 or 70. Another electrical signal is generated in conduit 82 by the interaction of conductor 76 of actuator 74 which moves with internal locking bar 32 relative to internal point locking rod 30. Such signal would indicate the locking of internal locking bar 32 with internal lock rod 30 or the unlocking of the same. Thus, the generation of signals by first and second actuators 36 and 74 reinforce one another to assure that points 22 or 24 are locked against rails 16 and 18, respectively with very close tolerances. It should also be noted, that if a point 22 or 24 should break, forked terminus 42 would sever from actuator 36, Forked terminus 42 may be constructed with a frangible portion to achieve this result. In this way, a broken point would also be detected by mechanism 10. FIG. 5 represents, schematically, the interacting of internal locking rod 30 and point detection bar 26 generating signals 60, 70, or 82 to show the position of points 22 and 24, either locked in extreme positions and fully switched via switch apparatus 12, or a transferring mode between the two extreme locked positions.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A railroad switching indicator mechanism for use with a point detector bar connected to a rail point, a point locking rod, and a cooperating locking bar, the point detector bar moving from a first position to a second position with the movement of a rail point against a rail comprising;

a. a first point detector bar receptor generating a first signal indicating the first position of the point detector bar;

b. a second point detector receptor generating a second signal indicating the second position of the point detector bar;

c. a first actuator, said first actuator comprising at least a breakable appendage being linked to the point indicator bar and being movable therewith, said appendage breaking with the breaking of the rail point, said first actuator selectively interacting with said first and second receptors to initiate the generating of said first and second signals with the movement of the rail point against the rail;

d. a third receptor generating a third signal indicating the cooperating locking of the point locking rod with the locking bar, and e. a second actuator connected to and moving with the locking bar, said second actuator interacting with said third receptor tot initiate the generation of said third signal.

2. The mechanism of claim 1 which further includes a fourth receptor generating a fourth signal indicating the unlocked condition of the point locking rod with the cooperating locking bar.

3. The mechanism of claim 2 in which said first actuator comprises an electrical conductor connecting to the breakable appendage linked to the point detector bar.

4. The mechanism of claim 3 in which said first and second point detector bar receptors each comprise electrical contacts.

5. The mechanism of claim 4 in which said second actuator comprises an electrical conductor appending to said cooperating locking bar.

6. The mechanism of claim 5 in which said third receptor comprises an electrical contact.

7. The mechanism of claim 2 in which said second actuator comprises an electrical conductor appending to said cooperating locking bar.

8. The mechanism of claim 7 in which said third receptor comprises an electrical contact.

9. The mechanism of claim 1 in which said first actuator comprises an electrical conductor connecting to the breakable appendage linked to the point detector bar.

10. The mechanism of claim 9 in which said first and second point detector bar receptors each comprise electrical contacts.

11. The mechanism of claim 1 in which said second actuator comprises an electrical conductor connecting to said cooperating locking bar.

12. The mechanism of claim 11 in which said third receptor comprises an electrical contact.

* * * * *